US007491005B2

(12) United States Patent
Blom

(10) Patent No.: US 7,491,005 B2
(45) Date of Patent: Feb. 17, 2009

(54) MOP/CLEANER HANDLE

(75) Inventor: Dan Blom, Studio City, CA (US)

(73) Assignee: Aquastar, Inc; Aquastar USA

( * ) Notice: Subject to any disclaimer, the term of this patent is extended or adjusted under 35 U.S.C. 154(b) by 654 days.

(21) Appl. No.: 11/139,085

(22) Filed: May 27, 2005

(65) Prior Publication Data

US 2005/0265769 A1 Dec. 1, 2005

Related U.S. Application Data

(60) Provisional application No. 60/574,913, filed on May 27, 2004.

(51) Int. Cl.
*A47L 1/08* (2006.01)
*A46B 11/04* (2006.01)

(52) U.S. Cl. ..... 401/137; 401/138; 401/272

(58) Field of Classification Search ..... 401/137, 401/138, 139, 140, 170, 176, 178, 169, 272
See application file for complete search history.

(56) References Cited

U.S. PATENT DOCUMENTS 4,119,386 A 10/1978 Cushing
4,695,176 A * 9/1987 Simonette et al. ..... 401/144
4,778,298 A * 10/1988 Shin et al. ..... 401/27
5,657,504 A 8/1997 Khoury
5,865,551 A * 2/1999 Lalli et al. ..... 401/139
6,146,041 A 11/2000 Chen et al.
6,227,744 B1 5/2001 Fodrocy et al.
6,244,771 B1 * 6/2001 Bruggeman et al. ..... 401/176
6,394,683 B1 5/2002 Pao
6,497,525 B1 * 12/2002 Huang ..... 401/138
6,612,768 B2 * 9/2003 Zorzo ..... 401/138
6,655,866 B1 12/2003 Morad et al.
6,854,912 B2 2/2005 Dyer et al.
2003/0077105 A1 * 4/2003 Hall et al. ..... 401/140
2003/0197027 A1 10/2003 Dyer
2004/0247370 A1 12/2004 Dyer et al.

* cited by examiner

*Primary Examiner*—David J Walczak
(74) *Attorney, Agent, or Firm*—Marc E. Hankin; Hankin Patent Law, APC

(57) ABSTRACT

A mop/cleaner handle that includes two chambers or hollow elements, in which fluid is transferred from one to the other before being sprayed out. In one specific device, one of the two chambers or hollow elements is slidable into the other, and each includes a one-way valve. In another, all or substantially all of the apparatus is enclosed within a tubular outer housing to.

6 Claims, 6 Drawing Sheets

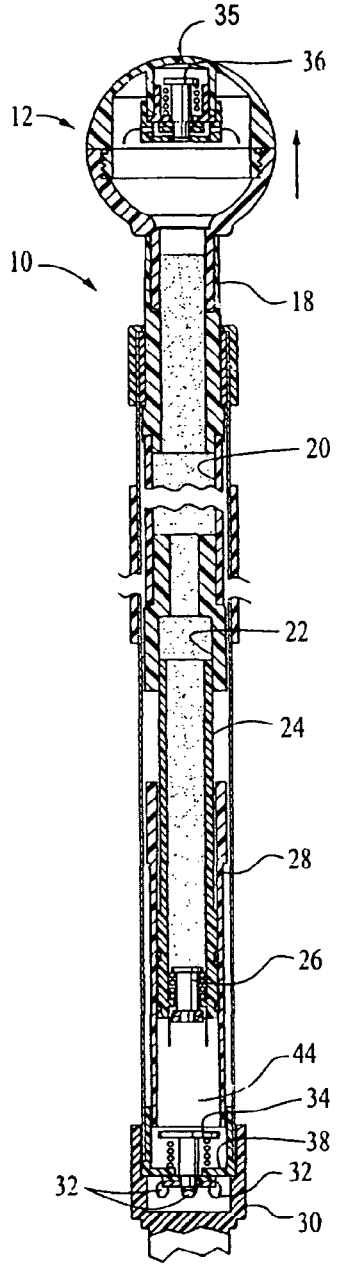
FIG. 3
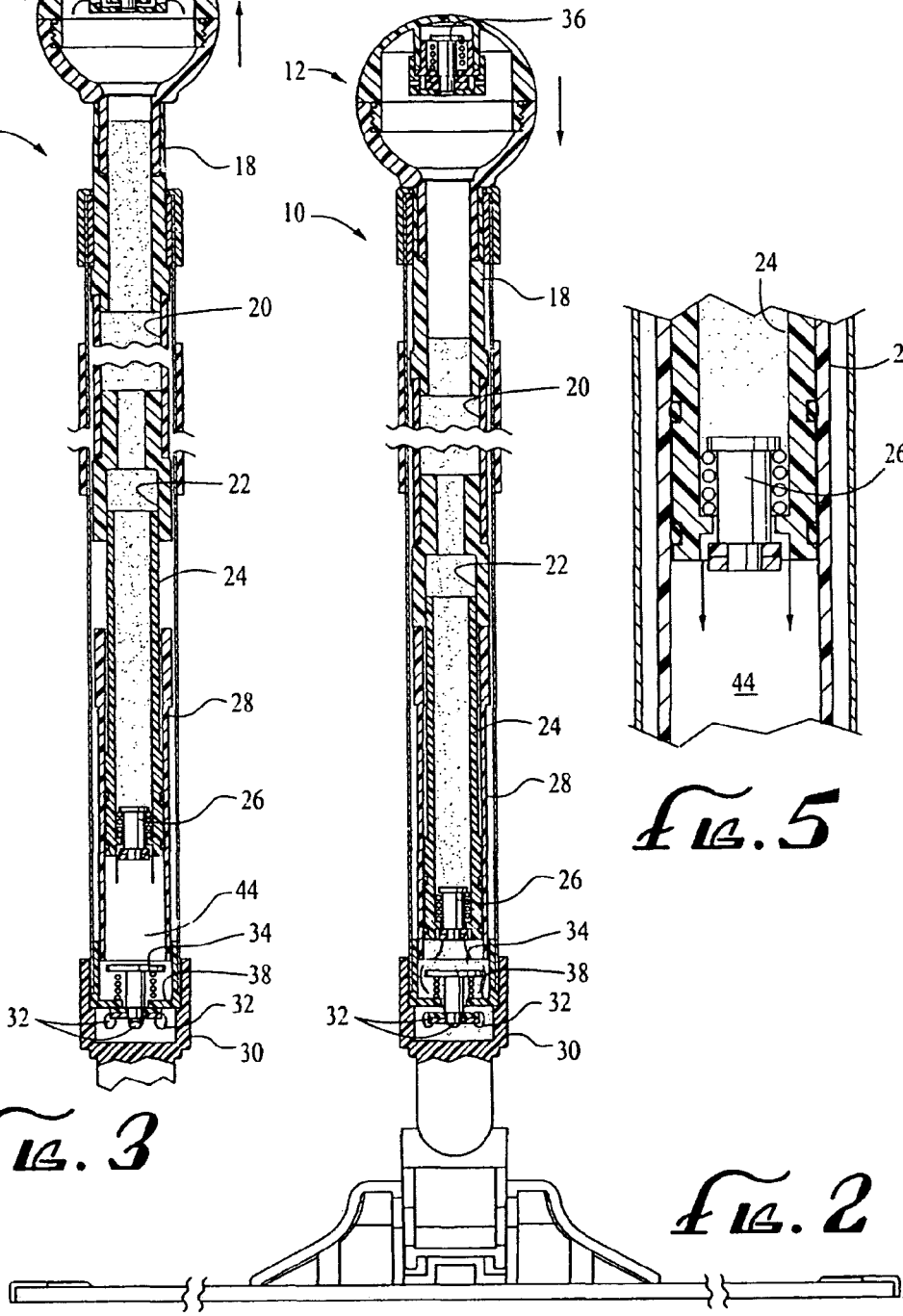
FIG. 2
FIG. 5

125
123
124
122
126
132
129
130
100
120
136
138
140
180
150
142
143
153
144
156
152
157
154
155
190
192
196

123
124
125
122
126
129
130
132
136
100
138
140
142
143
144
150
180
153
152
156
157
154
155
192
190
196

MOP/CLEANER HANDLE

Priority is claimed to U.S. Provisional Patent Application Ser. No. 60/574,913, filed on May 27, 2004, and titled "Cleaning Implement Liquid Dispensing Mechanism", which application is incorporated by reference herein as though set forth herein in full.

FIELD OF THE INVENTION

The present invention pertains to a handle for a cleaning device, such as a mop, and is particularly applicable to a handle that is capable of storing and spraying water and/or cleaning fluid.

BACKGROUND

A variety of conventional mop handles exist. Some of such handles include apparatuses for storing and/or releasing water or cleaning fluid. However, each of such conventional mop handles has significant disadvantages.

For example, U.S. Pat. No. 6,227,744 to Fodrocy, et al. (the '744 patent) describes a mop handle having a storage compartment within the mop handle itself. Fluid is released from within the compartment using a valve that is manually operated by pulling a trigger or other component. A mechanical linkage connects the trigger (or other manually operated component) with the dispensing outlet valve at a lower portion of the mop apparatus. Upon triggering the valve, fluid simply drains out of the compartment.

U.S. Pat. No. 6,655,866 to Morad et al. is similar to the '744 patent, except that: (i) rather than using a mechanical linkage to open the outlet valve, the '866 patent uses an air pressure system to open the release valve; and (ii) in the '866 patent, an external fluid compartment is attached to the mop handle. In any event, as with the '744 patent, after the valve is opened, it appears that the fluid simply drains out of the compartment. That is, in both of these patents, apparently the only force acting on the fluid itself is gravity.

SUMMARY OF THE INVENTION

In one aspect, the present invention provides an improved mop/cleaner handle that includes two chambers or hollow elements, with one of the two being slidable into the other, and with each having a check valve (or one-way valve). Such a configuration often can allow high-pressure spraying of water or cleaning fluid using a very natural back-and-forth motion that is consistent with the normal manipulation of the mop or other cleaning device.

Moreover, in the preferred embodiments of the invention, a rigid tube-shaped outer housing encloses nearly the entire length of both chambers or hollow elements (at least upon completion of the downward stroke), resulting in a look and feel that is nearly identical to a conventional non-spraying mop/cleaner handle. This is significantly different than most conventional spray mops that require an external container and therefore result in a vacuum-cleaner-like appearance and/or an awkward unbalanced feel.

The foregoing summary is intended merely to provide a brief description of the general nature of the invention. A more complete understanding of the invention can be obtained by referring to the claims and the following detailed description of the preferred embodiments in connection with the accompanying figures.

BRIEF DESCRIPTION OF THE DRAWINGS

FIG. 2 is an elevational sectional view of the mop/cleaner apparatus of FIG. 1.

FIG. 3 is an elevational sectional view similar to the view of FIG. 2, showing components in different positions of operation.

FIG. 5 is an enlarged sectional view of a valve portion of the mop/cleaner apparatus of FIG. 2.

DESCRIPTION OF THE PREFERRED EMBODIMENT(S)

First Representative Embodiment

Figures 1, 4:
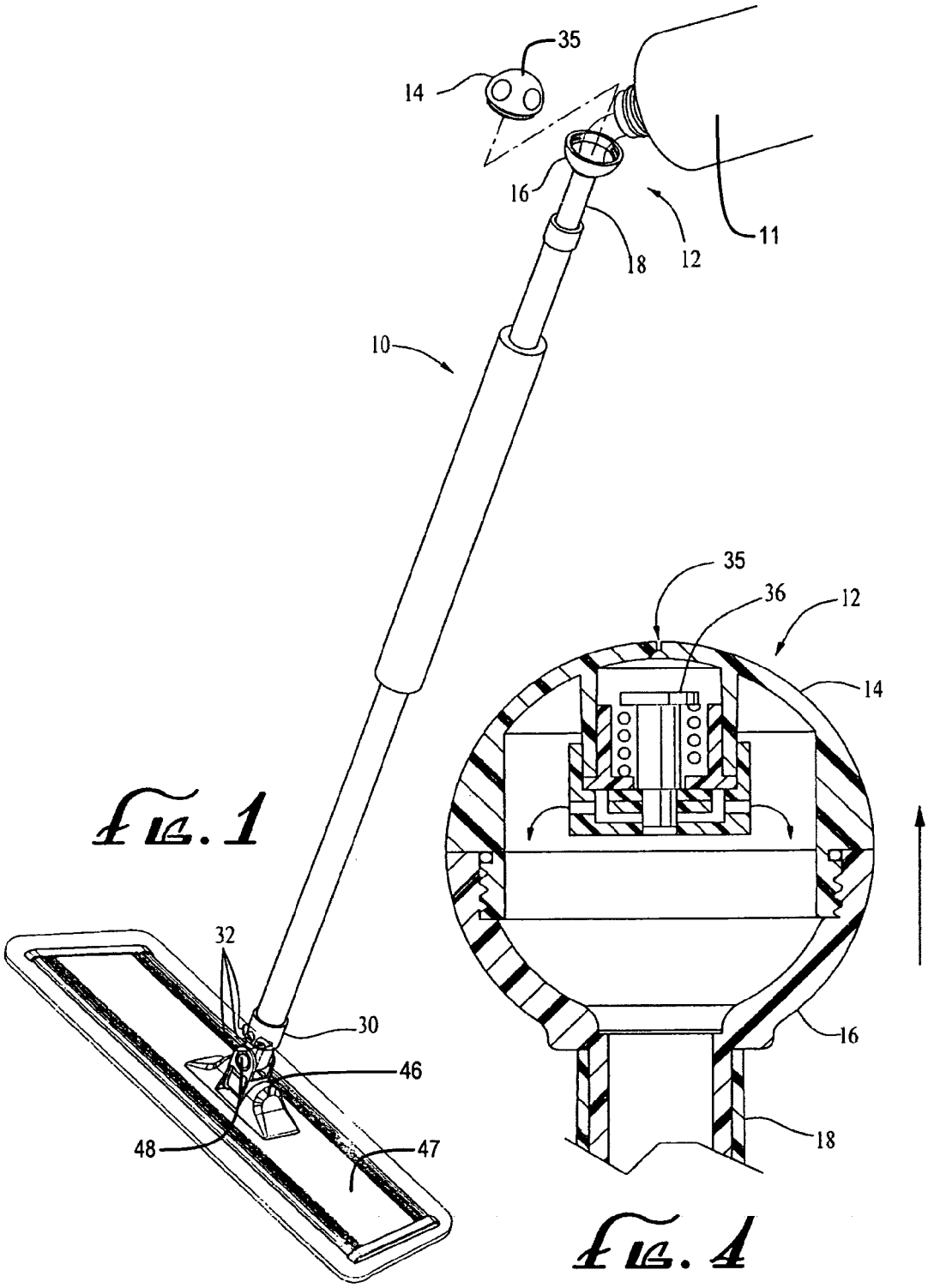
FIG. 1 is a perspective view of a mop/cleaner apparatus according to a first representative embodiment of the present invention.
FIG. 4 is an enlarged sectional view of the upper ball portion of the mop/cleaner apparatus of FIGS. 2 and 3.

Referring to the drawings, FIGS. 1 and 2 show the overall apparatus 10 of the first representative embodiment of the invention. The lower portion 46 of the apparatus 10, comprising a pivotal floor-engaging portion, is conventional.

Figure 7:
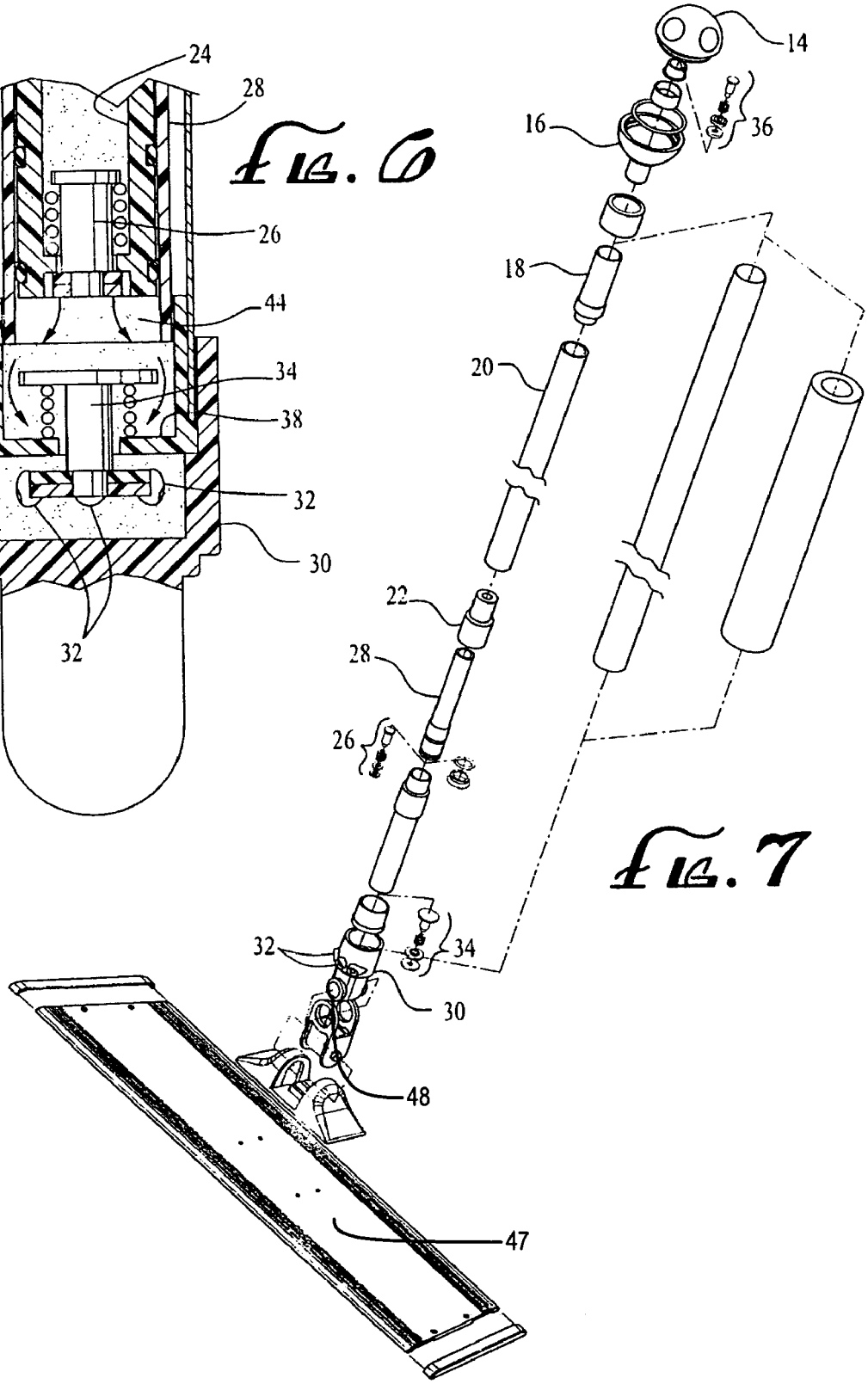
FIG. 7 is an exploded perspective view of the mop/cleaner apparatus of FIGS. 1 and 2.

Preferably, lower portion 46 includes a cleaning element 47 (or at least an attachment device 48 for detachably attaching a cleaning element 47) at its distal end. In different embodiments of the invention, cleaning element 47 is: any type of mop head, cleaning pad, sponge or other cleaning element, but in the preferred embodiment of the invention cleaning element 47 comprises a microfiber pad. Attachment device 48 preferably uses any combination of screws, clips, pins, flexible resilient locking tabs, clamps, guides or any other known means for attaching a cleaning element 47. In the particular environment shown in FIG. 7, attachment device 48 comprises a pin that passes through two holes in the lower portion of the mop handle to secure the cleaning element 47 to the mop handle.

FIGS. 2 and 3 are sectional views showing the components of a preferred embodiment before and after actuation of the apparatus 10, respectively, to spray water or other liquid out from openings 32 in its lower portion.

The mop apparatus 10 comprises an upper ball or spherical portion 12 having upper portion 14 threadedly connected with lower portion 16.

The ball member 12 is connected by the tubular members 18, 20, 22 and 24 connected together longitudinally of the device. A valve 26 is mounted in the lower end portion of the tubular member or plunger 24, and the plunger 24 is slidable in an outer sleeve member 28. Mounted within a lower housing member 30 having therein outlet spray openings 32, is a valve 34 mounted in a lower wall member 38, as shown.

The mop assembly is filled with water by pouring from a container 11, as shown in FIG. 1, into the lower ball portion 16 which serves as a funnel. The water then passes downwardly into the mop assembly.

Water or liquid is retained in the interior of the mop assembly. The operator pushes downwardly on the ball 12 from its position of FIG. 3 to its lower position of FIG. 2.

The tubular interior of the mop transmits pressure from the ball downwardly to the valve 34 in the lower portion of the apparatus.

The lowermost tubular member, plastic sleeve 28, does not move relative to the assembly.

With the ball moved toward the upward position, atmospheric air is admitted to the ball chamber, thus breaking the partial vacuum therein and allowing water to flow downwardly.

The low pressure that is developed in chamber 44 overcomes the spring force of the valve 26, which is mounted on tubular member 24, and the partial vacuum is eliminated as the chamber 44 fills with water.

Figure 6:
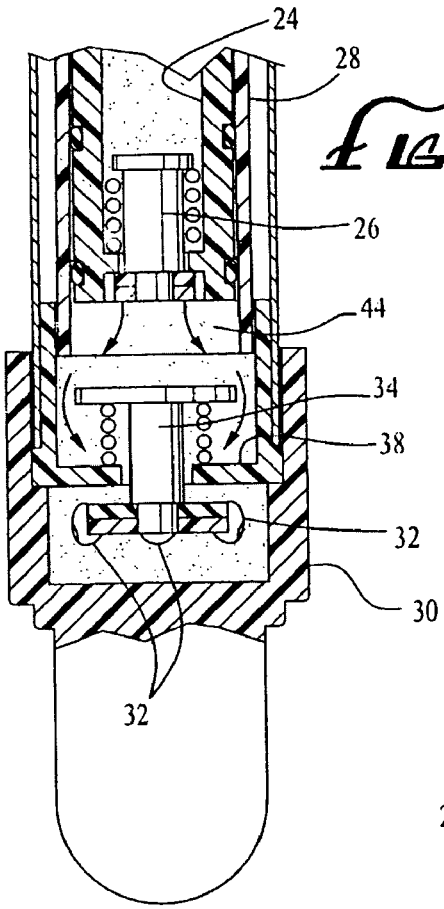
FIG. 6 is an enlarged sectional view of a lower portion of the apparatus of FIGS. 2 and 3.

Referring to FIGS. 6 and 2, the downward pushing of the ball 12 effects removal of water from the chamber 44, and the water is urged past bottom valve 34 and outwardly of the mop housing via the spray openings 32.

The apparatus according to this embodiment of the invention essentially functions by utilizing three valves, an air inlet 35 and corresponding inlet valve 36 in the upper ball portion 12 to eliminate a partial vacuum in the ball member 12, and two lower valves which in effect serve as check valves

Second Representative Embodiment

Figure 8:
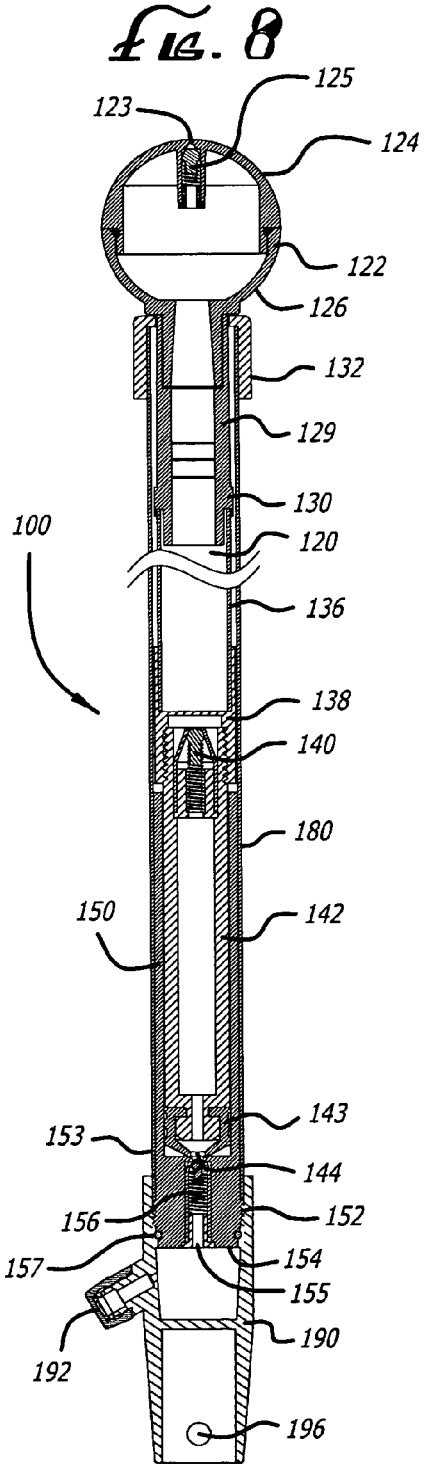
FIG. 8 is an elevational sectional view of a mop/cleaner apparatus handle according to a second representative embodiment of the present invention, with its upper section in the "down" position.
Figure 9:
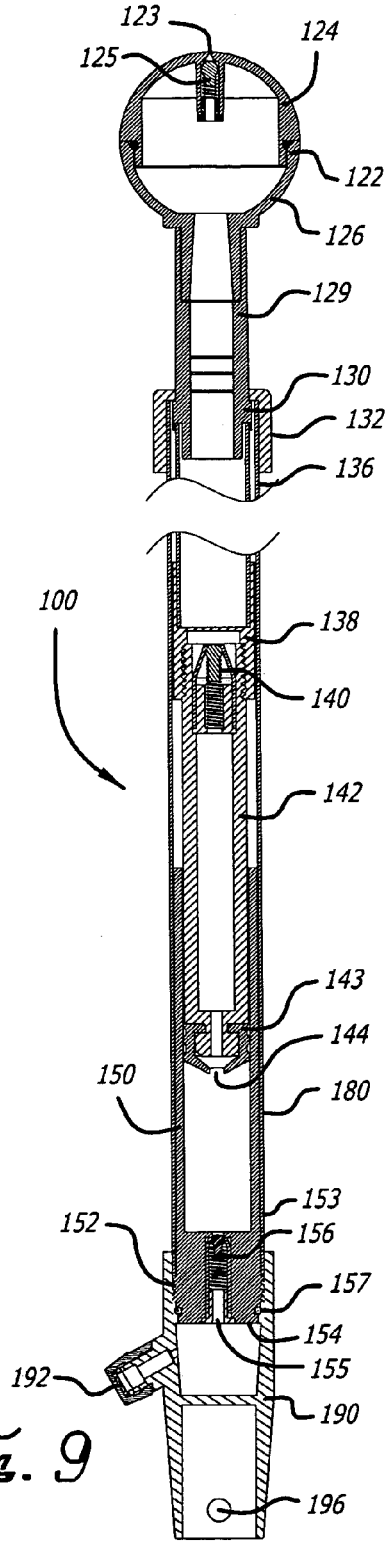
FIG. 9 is an elevational sectional view of the handle shown in FIG. 8, but with its upper section in the "up" position.
Figure 10:
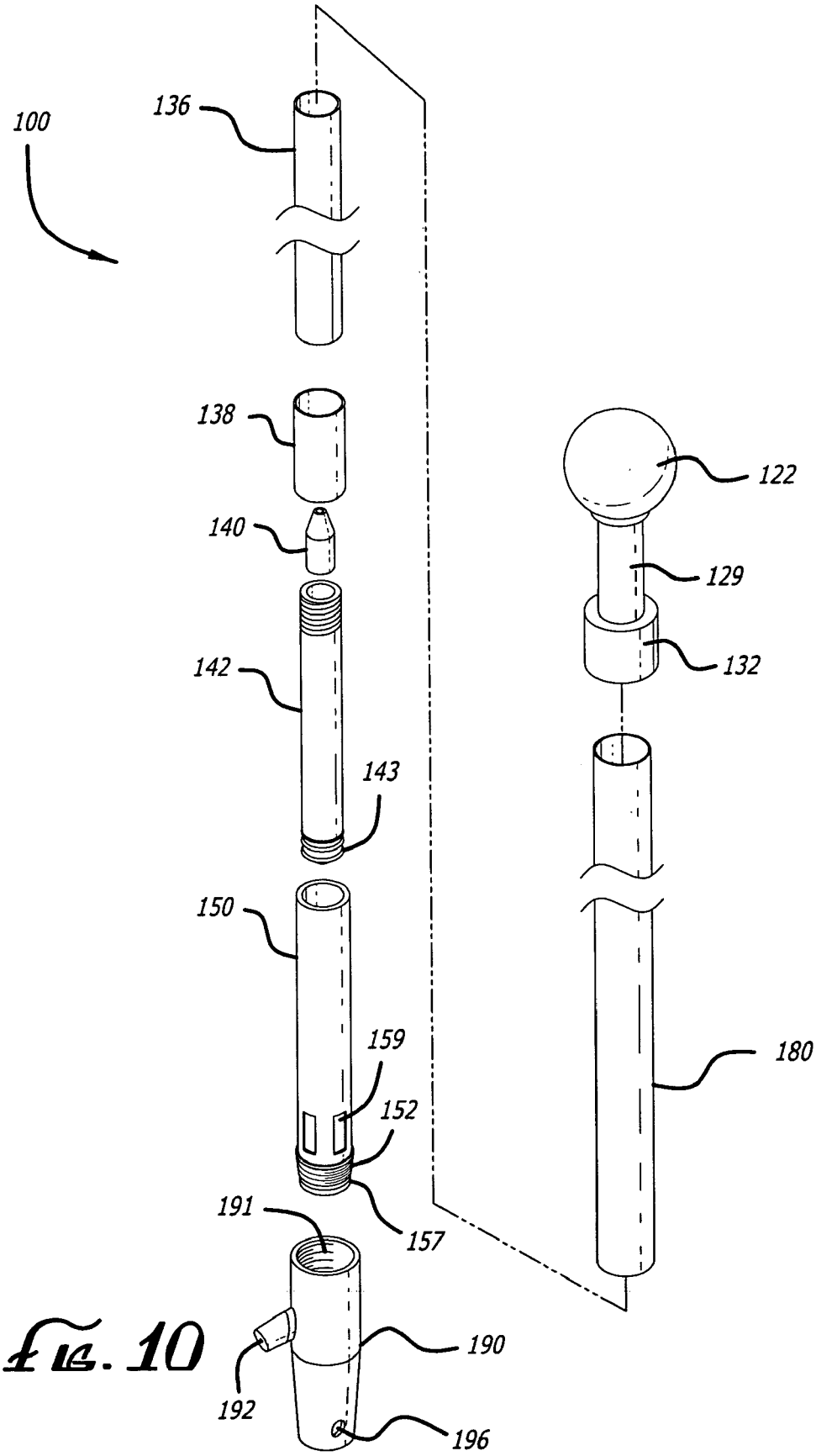
FIG. 10 is an exploded view of the handle shown in FIG. 8.

A mop/cleaner handle assembly 100 according to a second representative embodiment of the invention is now described with reference to FIGS. 8-10. Handle assembly 100 basically consists of four main components: an upper section 120, a lower section 150, an outer housing 180 and a bottom portion 190. The upper section 120 slides or telescopes into the lower section 150, and the outer housing 180 encloses nearly all of the upper section 120 (particularly when the upper section is in the "down" position shown in FIG. 8), as well as all, or nearly all, of the lower section 150. The bottom portion 190 is fixedly attached to the lower section 150 (using a threaded connection 152 in the current embodiment), and the outer housing 180 is fixedly attached to the lower section 150 (by crimping outer housing 180 at position 153 in the present embodiment).

Beginning from the top, upper section 120 includes a ball portion 122 (e.g., having a diameter of 1½-2 inches) that consists of a top hemisphere 124 and a bottom hemisphere 126, with top hemisphere 124 being removable (e.g., by unscrewing it in the present embodiment) and thereby functioning as a cap. Built into top hemisphere 124 is a spring-biased normally closed one-way valve 125 that permits downward flows of air through top opening 123 into the remainder of upper section 120, but generally blocks upward flows. As in the previous embodiment, with top hemisphere 124 detached, bottom hemisphere 126 functions as a funnel for pouring water or other liquid into handle assembly 100. The use of spherical element 122 is preferred because it provides both a fluid inlet and a convenient means for grasping upper section 120. However, in other embodiments of the invention various other types of inlets for allowing a user to fill handle assembly 100 with fluid and/or grips are provided.

Lower hemisphere 126 opens into a short hollow tube-shaped section 129 (e.g., of approximately 3 inches in length). A slightly larger diameter ring-shaped shoulder 130 is fixedly attached to section 129. Immediately above shoulder 130 is a cylindrically shaped collar 132 having an upper diameter that it is just slightly larger than the diameter of section 129, but smaller than the diameter of shoulder 130, so that collar 132 can freely slide relative to section 129, from a position where its top surface contacts the bottom of lower hemisphere 126 (as shown in FIG. 8) to a position where its top surface just rests on the top of shoulder 130 (as shown in FIG. 9). The diameter of the lower end of collar 132 is just large enough to tightly fit over the out of diameter of outer housing 180, and collar 132 is in fact attached to outer housing 180 in this manner. Accordingly, when handle assembly 100 has been fully constructed collar 132 remains stationary (relative to outer housing 180) while ball 124 and section 129 can be moved up and down, with collar 132 constraining the amount of such movement as indicated above.

An elongated tube 136 (e.g., of approximately 3½-4 feet in length and ¾ inch in diameter) is attached to the bottom of section 129 (preferably using a frictional fit), with a tightly fitting sleeve 138 securely attaching the distal end of tube 136 to a spring-biased normally closed one-way valve 140 that permits downward flows, but generally blocks upward flows. Valve 140, in turn, is fixedly attached to hollow plunger 142 (e.g., of approximately 4-6 inches in length and ¾ inch in diameter), which has a resilient deformable (e.g., rubber or synthetic rubber) component 143 (e.g., ½ inch long) at its distal end that includes a small bottom opening 144 (e.g., having a ⅛ inch diameter).

It is noted that each of the components of upper section 120 discussed above preferably is hollow, with the only potential complete obstruction from lower hemisphere 126 to bottom opening 144 being valve 140.

Lower section 150 preferably is formed as a hollow hard plastic tube (e.g., approximately 5 inches in length and ¾-1 inch in diameter) having a partially closed bottom surface 154. Surface 154 has only a small opening 155 (e.g., approximately ⅛ inch in diameter), through which flows are regulated by spring-biased normally closed one-way valve 156 that permits downward flows through opening 155, but generally blocks upward flows. As noted above, threaded portion 152 allows lower section 150 to attach to a mating threaded portion 191 in bottom portion 190. A rubber (or synthetic rubber) o-ring 157 helps to provide the seal between lower section 150 and bottom portion 190. Preferably, indented portions 159 are provided just above threaded section 152. By crimping the bottom portion of outer housing 180 at such indented portions 159, a very secure attachment often can be created.

The upper end of lower section 150 preferably has an inner diameter that is just large enough to accommodate deformable component 143. As shown in the drawings, component 143 preferably has a series of outwardly extending ridges which deform slightly when upper section 120 is inserted into lower section 150, creating a tight seal that prevents fluid from entering the space between upper section 120 and outer housing 180.

As noted above, bottom portion 190 preferably has a threaded section 191 for accepting the threaded section 152 of lower section 150. The upper part of bottom portion 190 preferably is formed as a hollow cylinder having an open top and a closed bottom, with the only outlet being through nozzle 192, which functions as the outlet for assembly 100. In the preferred embodiments of the invention, nozzle 192 is configured so as to produce a fine mist when pressurized water (or other fluid of similar viscosity) is applied. The bottom part of portion 190 preferably it is not part of the spraying mechanism, but rather is provided with a means (e.g., means 48) for attaching a mop head or other cleaning element 47. In the present embodiment, the attachment means 48 comprises a pair of holes 196 through an otherwise hollow tapered cylindrical bottom part, as shown in FIGS. 8 and 9, through which a pin or similar device attached to cleaning element 47 may be inserted.

Outer housing 180 preferably is formed as a single elongated aluminum tube. Optionally, a section of gripping material (e.g., a tube-shaped section of foam rubber; not shown) may be installed on the outer surface, e.g., near the top of housing 180, e.g., both for comfort and to allow a user to maintain a good grip on outer housing 180. As noted above, housing 180 preferably encloses all, nearly all or a substantial portion of both upper section 128 and lower section 150. In such preferred embodiments, the main goal is to provide a mop/cleaner handle that looks and feels as much as possible like a conventional non-spraying handle. Accordingly, in these embodiments some portion of either or both sections may extend outside of the enclosure of housing 180, provided that such extensions are not so significant as to defeat this goal. In fact, in the preferred embodiments discussed above some portion of the upper section 120 (preferably no more than 2-3 inches) extends above the top of housing 180 when it is in the "up" position.

Toward this end, outer housing 180 preferably is sized similarly to conventional mop/cleaner handles. For example, when used for a mop outer housing 180 preferably is approximately 4-5 feet long and approximately 1-1½ inches in diameter. More preferably, the diameter preferably is just under an inch, with a foam-rubber grip section of approximately 16 inches in length of that widens housing 180 at the interval from approximately 1 inch to approximately 1½ inches.

Thus, in the present embodiment upper section 120 includes a number of different sections and components (e.g., ball portion 122, short hollow tube-shaped section 129, ring-shaped shoulder 130, collar 132, elongated tube 136, tightly fitting sleeve 138, valve 140, plunger 142, deformable component 143 and bottom opening 144), but generally is configured as a hollow tube-shaped chamber with a single one-wave valve 140 for allowing flows into lower section 150 but blocking reverse flows. lower section 150 can be formed from early as a single unitary cylindrically shaped piece with a threaded outer lower portion 152 and a bottom surface 154 with opening 155, but also including valve 156, o-ring 157 and indented portions 159. Finally, bottom portion 190 also can be formed as a unitary piece having a mating threaded portion 191, a nozzle 192 and holes 196 (or other means for attaching a cleaning element).

Conceptual Discussion

Figure 13:
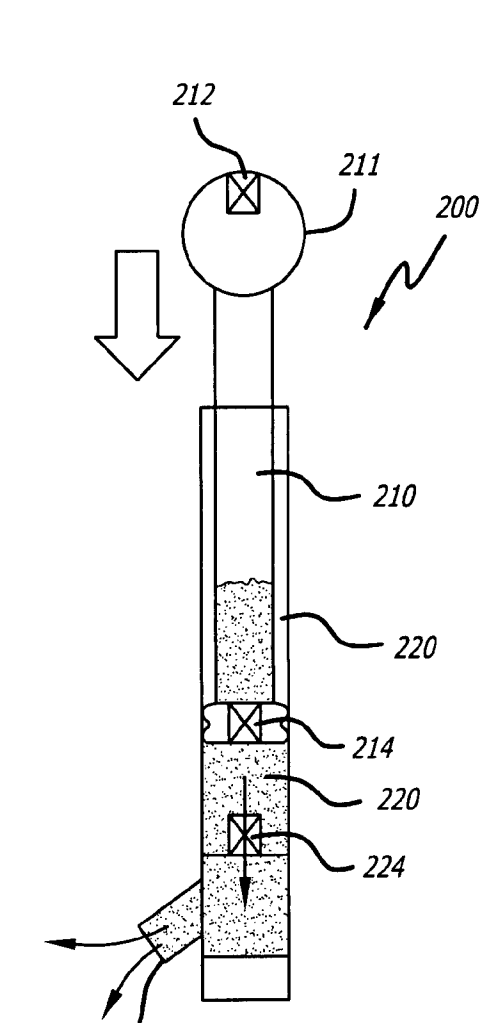
FIG. 13 is a conceptual drawing of the mop/cleaner handle shown in FIG. 11, with the upper chamber having been pressed once again to the "down" position.
Figure 12:
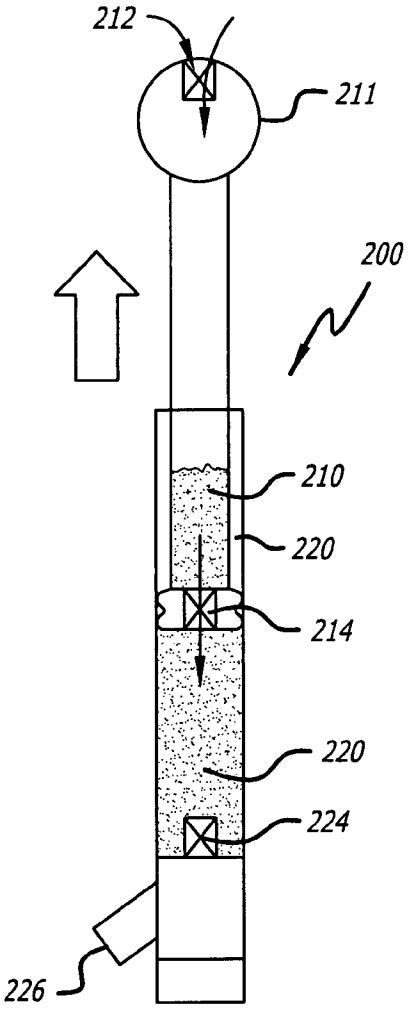
FIG. 12 is a conceptual drawing of the mop/cleaner handle shown in FIG. 11, with the upper chamber having been raised to the "up" position.
Figure 11:
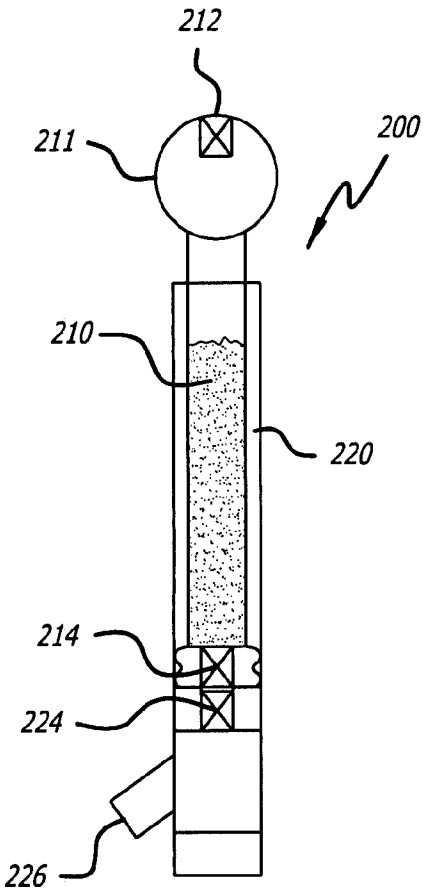
FIG. 11 is a conceptual drawing of a mop/cleaner handle according to a preferred embodiment of the invention, with the upper chamber initially in the "down" position.

This section discusses the concepts underlying the specific embodiments discussed above. FIGS. 11-13 provide simplified, conceptual views to illustrate the operation of a mop/cleaner handle assembly 200, e.g., according to the first and second embodiments discussed above.

As shown in FIGS. 11-13, handle assembly 200 preferably primarily includes an upper chamber (or hollow member) 210 and a lower chamber (or hollow member) 220. Each of elements 210 and 220 is configured primarily as a hollow cylinder in the preferred embodiments of the invention.

In the preferred embodiments, upper chamber 210 slides (or telescopes) into and out of lower chamber 220, with the inner diameter of lower chamber 220 just accommodating the outer diameter of upper chamber 210 (i.e. so that no significant gap exists between the two elements), and a seal is provided at the bottom of upper chamber 220.

Upper chamber 210 preferably has a spring-biased check valve (or one-way valve) 214 at its distal end, allowing flows downwardly if a sufficient amount of pressure is applied, but blocking flows upwardly (other than any leakage). Examples of valve 214 are valves 26 and 140 discussed above. In the preferred embodiments, valve 214 preferably functions as the only passage between upper chamber 210 and lower chamber 220. Lower chamber 220 preferably has a spring-biased check valve (or one-way valve) 224 at its distal end, also allowing flows downwardly if a sufficient amount of pressure is applied, but blocking flows upwardly. Examples of valve 224 are valves 34 and 156 discussed above. In the preferred embodiments, valve 224 preferably functions as the only opening out of lower chamber 220, and valve 214 functions as the only opening into lower chamber 220. Each of the valves 214 and 224 preferably is sufficiently spring-biased so that the mere weight of water within upper chamber 210 or lower chamber 220, respectively, is not alone sufficient to open the corresponding valve 214 or 224.

In operation, upper chamber 210 initially is filled with fluid and lower chamber 220 initially is empty. If upper chamber 210 initially is in the "up" position (e.g., as generally shown in FIG. 12), then the user may press downwardly on upper chamber 210. In this case, upper chamber 210 acts as a piston, pushing any air within lower chamber 220 out through valve 224. It is noted that, due to its one-way nature, valve 214 generally prevents any such air from entering upper chamber 210. At the end of this "downward stroke", the apparatus 200 is in the position shown in FIG. 11.

Once in the lower position, a user may pull upwardly on sphere 212. In this case, a vacuum will tend to be created in lower chamber 220 as its volume increases. It is noted that, due to its one-way nature, valve 224 generally prevents air from reentering chamber 220 from its distal end. However, the resulting differential in pressure between upper chamber 210 and lower chamber 220 causes valve 214 to open, allowing fluid to enter lower chamber 220 from upper chamber 210. As this occurs, the fluid level in upper chamber 210 drops, creating a partial vacuum above the fluid level in upper chamber 210.

Consequently, air is drawn into upper chamber 210. In the present embodiment, air is drawn in through spring-biased normally closed one-way valve 212 that permits downward flows of air through a top opening into the remainder of upper section 120, but generally blocks upward flows. In alternate embodiments (where such an opening and valve 212 are omitted), air may be drawn in through the imperfect seal in the cover for the fluid inlet or through any other opening in upper chamber 210. In any event, at the end of this "upward stroke", the apparatus 200 is in the position illustrated in FIG. 12.

The effect of a further downward stroke at this point is the same as set forth above. However, in this case, rather than pushing out air, the fluid in the lower chamber 220 is pushed out through valve 224 and then through nozzle 226, which functions as the only outlet for apparatus 200. Because of the pressure that is applied via the downward stroke, and depending upon the configuration of nozzle 226, in the preferred embodiments of the invention the fluid is sprayed out as a fine mist that is appropriate for use when cleaning with a microfiber pad.

The foregoing process then may be repeated any number of times, alternately filling chamber 220 with fluid from chamber 210 (with an upstroke) and then pushing the fluid out of chamber 220 (with a downstroke) through nozzle 226, until the fluid level within upper chamber 210 is beneath the level of the input port of valve 214 (i.e., too low to allow any additional fluid to be drawn into chamber 220).

It is noted that in the illustrated embodiments of the invention the upward stroke generally may only be performed with the apparatus 200 in an essentially upright position (i.e., one in which is the fluid is at the distal end of upper chamber 210). However, once lower chamber 220 has been filled with fluid the apparatus 200 may be maneuvered into an "upside down" position in which the fluid within upper chamber 210 collects at its proximal end. Even from this upside down position, the downward stroke can be performed, causing the fluid within lower chamber 222 to spray out through the nozzle 226. The reason for this is that in the preferred embodiments of the invention the spraying action depends primarily upon pressure generated from the downward stroke, rather than from gravity. As a result, a mop or other cleaning device according to the present invention can be utilized to clean ceilings or other high places. This is a distinct advantage over conventional gravity-based spraying devices, such as those described above.

As indicated above, some form of opening generally should be provided in the upper chamber 210 in order to allow entry of air during the upward stroke. At the same time, the existence of such an opening can lead to fluid leakage when the apparatus 200 is maneuvered into an upside down orientation. There are at least two possible approaches to solving this problem. One (as shown in FIGS. 11-13) is to use a check valve 212 in upper chamber 210 that permits inward flows (of air) but generally blocks outward flows (e.g., fluid leakage). Another is to use very small openings in upper chamber 210 that allow air to enter but that limit the amount of fluid leakage. Finally, any combination of these two approaches may be utilized.

The above description emphasizes the function of an apparatus according to the preferred embodiment of the invention. As will be readily apparent, variations are possible. For instance, the simple conceptual drawings in FIGS. 11-13 show check valve 214 as being at the very bottom of upper chamber 210, while in the first and second embodiments discussed above the corresponding check valve is disposed above the plunger portion of the upper chamber.

As discussed in connection with the first and second embodiments above, lower chamber 220 preferably is fixedly attached to the outer housing, and upper chamber 210 extends somewhat above the top of outer housing. As a result, one generally need only grasp the outer housing with one hand and the top sphere 211 (or similar gripping element) with the other in order to move upper chamber 210 up and down, sliding it into and out of lower chamber 220 (although the outer housing generally will obscure the relationship between upper chamber 210 and lower chamber 220). In certain embodiments, a sphere 211 or similar element prevents upper chamber 210 from extending too far into lower chamber 220. In others, upper chamber 210 can be inserted into lower chamber 220 until the bottom surface of upper chamber 210 contacts the bottom inner surface of lower chamber 220 (essentially permitting lower chamber 220 to be completely evacuated). A mechanical stop (e.g., a combination of elements 130 and 132) preferably prevents upper chamber 210 from being fully removed from lower chamber 220.

Additional Considerations

It should be noted that in the discussion above terms such as "up" and "down" are used. These terms generally are intended to refer to relative positions when the mop/cleaner handle is oriented such that the cleaning element is resting on the floor.

Also, several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A mop/cleaner handle, comprising:

a hollow upper member having a top end, a bottom end, and a first one-way valve;

a hollow lower member having an inner dimension that is just large enough to accommodate the bottom end of the hollow upper member, a top end, a bottom end, and a second one-way valve; and an outlet disposed beneath the second one-way valve;

wherein the bottom end of the hollow upper member is slidably disposed within the hollow lower member;

wherein the first one-way valve is spring-biased closed, blocking an upward flow, and permitting a downward flow only when sufficient downward pressure exists to overcome the spring bias;

wherein even when the hollow upper member is filled with water, the weight of said water alone is not sufficient to overcome the spring bias of the first one-way valve; and wherein pulling the hollow upper member upwardly with respect to the hollow lower member creates a vacuum within the hollow lower member that is sufficient to overcome the spring bias of the first one-way valve, causing water from the hollow upper member to flow downwardly into the hollow lower member.

2. A mop/cleaner handle according to claim 1, wherein the second one-way valve is spring-biased closed, blocking an upward flow, and permitting a downward flow only when sufficient downward pressure exists to overcome the spring bias.

3. A mop/cleaner handle according to claim 2, wherein even when the hollow lower member is filled with water, the weight of said water alone is not sufficient to overcome the spring bias of the second one-way valve.

4. A mop/cleaner handle according to claim 3, wherein when the hollow lower member is filled with water and the hollow upper member is pressed downwardly with sufficient force relative to the hollow lower member, the first one-way valve blocks the water in the hollow lower member from entering the hollow upper member, and the resulting pressure opens the second one-way valve, allowing the water to escape through the outlet.

5. A mop/cleaner handle according to claim 4, wherein the water escapes through the outlet as a pressurized spray.

6. A mop/cleaner handle, comprising:

a hollow upper member having a top end, a bottom end and a first one-way valve;

a hollow lower member having: an inner dimension that is just large enough to accommodate the bottom end of the hollow upper member, a top end; a bottom end and a second one-way valve; and an outlet disposed beneath the second one-way valve;

wherein the bottom end of the hollow upper member is slidably disposed within the hollow lower member;

wherein the first one-way valve is spring-biased closed, blocking an upward flow, and permitting a downward flow only when sufficient downward pressure exists to overcome the spring bias;

wherein the second one-way valve is spring-biased closed, blocking an upward flow, and permitting a downward flow only when sufficient downward pressure exists to overcome the spring bias;

wherein even when the hollow lower member is filled with water, the weight of said water alone is not sufficient to overcome the spring bias of the second one-way valve; and wherein when the hollow lower member is filled with water and the hollow upper member is pressed downwardly with sufficient force relative to the hollow lower member, the first one-way valve blocks the water in the hollow lower member from entering the hollow upper member, and the resulting pressure opens the second one-way valve, allowing the water to escape though the outlet.

* * * * *